US007249864B2

(12) United States Patent
Smith et al.

(10) Patent No.: US 7,249,864 B2
(45) Date of Patent: Jul. 31, 2007

(54) PORTABLE LAMP WITH DETACHABLE STAND

(75) Inventors: Ben Cameron Smith, 5425 Ballard Ave., NW. Unit #2, Seattle, WA (US) 98107; Adam Smith, Olalla, WA (US)

(73) Assignee: Ben Cameron Smith, Seattle, WA (US)

( * ) Notice: Subject to any disclaimer, the term of this patent is extended or adjusted under 35 U.S.C. 154(b) by 0 days.

(21) Appl. No.: 11/134,211

(22) Filed: May 21, 2005

(65) Prior Publication Data

US 2006/0262523 A1 Nov. 23, 2006

(51) Int. Cl.
*F21L 4/00* (2006.01)

(52) U.S. Cl. ..... 362/183; 362/391; 362/800

(58) Field of Classification Search ..... 362/183, 362/800

See application file for complete search history.

(56) References Cited

U.S. PATENT DOCUMENTS 4,719,549 A * 1/1988 Apel ..... 362/421
6,565,243 B1 * 5/2003 Cheung ..... 362/800
6,592,241 B1 * 7/2003 Kovacik et al. ..... 362/398
6,693,556 B1 * 2/2004 Jones et al. ..... 362/800
6,773,139 B2 * 8/2004 Sommers ..... 362/237
6,964,510 B2 * 11/2005 Galli ..... 362/800
6,966,669 B2 * 11/2005 Hussaini et al. ..... 362/183
2004/0212991 A1 * 10/2004 Galli ..... 362/157
2005/0213324 A1 * 9/2005 Chen ..... 362/249

* cited by examiner

*Primary Examiner*—Ali Alavi
*Assistant Examiner*—William J Carter
(74) *Attorney, Agent, or Firm*—DWC Law Firm, P.S.

(57) ABSTRACT

A portable LED lamp can be removably attached to a stand. The stand has connectors that are usable to retain the lamp as well as supply power to the lamp from an external-power supply source. The connectors can also serve as pivot points for a user to pivot the portable LED lamp when it is attached to the stand. In some embodiments, a dual level circuit board assembly is also provided for the portable LED lamp, with LEDs coupled to both levels of the circuit board assembly.

26 Claims, 6 Drawing Sheets

PORTABLE LAMP WITH DETACHABLE STAND

BACKGROUND

1. Field of the Invention

The present invention relates generally to portable lamps.

2. Description of Related Art

Table lamps (or desk lamps) serve a wide range of purposes within the home, from bedside reading lamps to desk study lamps to mood-enhancing living room lamps. Many homes are outfitted with a large collection of differing types of table lamps, each being necessary for serving different purposes, such as providing different levels and qualities of light for different activities.

Also, portable lights, such as flashlights, are often kept within homes. These lights sources can be conveniently and portably taken from room to room or on trips to illuminate otherwise dark areas temporarily, without the need for external power supply. For most table lamps, that is impractical, as many require external electrical power sources.

It would be desirable to have a table lamp that can serve multiple lighting purposes, but which also has aesthetic appeal for the home and is power efficient, for long-term use without an external power source.

BRIEF SUMMARY OF THE INVENTION

In some embodiments of the present invention, a lamp assembly is provided with a stand having a base and two elongated support members. Connectors are coupled to upper end portions of the elongated support members and may be spherical in shape. A portable lamp is provided, having mating portions configured to mate with the connectors in removable fashion for removably attaching the portable lamp to the stand. The mating portions can comprise magnets that attract the connectors (which can be metallic) of the stand for assisting in retaining the portable lamp on the stand.

Moreover, the magnets can be disposed behind metallic contact surfaces of the portable lamp, such that the contact surfaces come into contact with the connectors when the portable lamp is attached to the stand. In some embodiments, the contact between the connectors and the contact surfaces can close a circuit for providing external power supply to the portable lamp through the connectors and contact surface. The portable lamp can have a battery and thus be charged when attached to the stand. Also, in some embodiments, the portable lamp can be selectively pivotable about an axis between the connectors and the magnets.

In some embodiments of the present invention, when the portable lamp is removed from the stand, it can be used to provide portable light, such as for use as a flashlight. When it is attached to the stand, it can be used as stationary desk or table light.

DETAILED DESCRIPTION OF PREFERRED EMBODIMENTS

In the following description, certain specific details are set forth in order to provide a thorough understanding of various embodiments of the invention. However, upon reviewing this disclosure one skilled in the art will understand that the invention may be practiced without many of these details. In other instances, well-known structures associated with light-emitting diodes (LED), LED circuit configurations, light switches, dimmers and/or light intensity control circuits, batteries and power adaptors have not been described in detail to avoid unnecessarily obscuring the descriptions of the embodiments of the invention.

Throughout various portions of the following description, the embodiments of the present invention are described in the context of a portable lamp that is detachable from a stand. However, as will be understood by those skilled in the art, various embodiments of the present invention have a wide variety of other lighting applications. For example, some embodiments of the present invention can comprise only a portable lamp with no detachable stand.

Figure 1B:
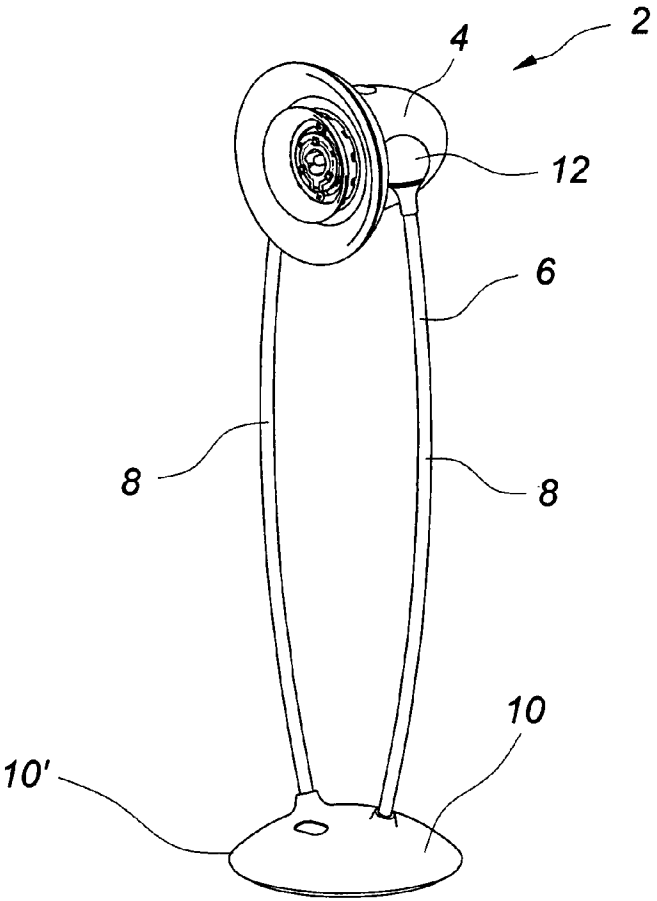
FIG. 1*b* is a perspective view of the portable lamp assembly of FIG. 1*a*, with the portable lamp attached to the stand.
Figure 1A:
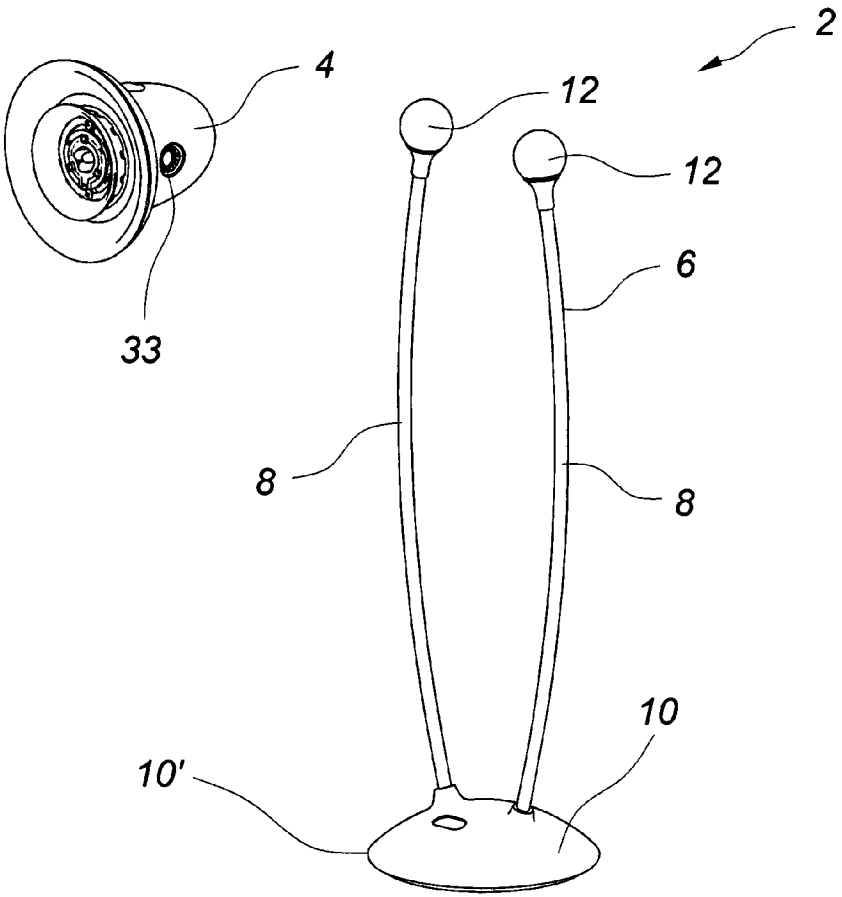
FIG. 1*a* is a perspective view of an embodiment of a portable lamp assembly of the present invention having a portable lamp and a stand, with the stand detached from the portable lamp.

Referring to FIGS. 1*a* & 1*b*, some embodiments of the present invention relate to a portable lamp 4 with stand 6, which together form a lamp assembly 2. The stand 6 can have upright support members 8 and a base 10. The support members 6 can be cylindrical in shape (e.g., circular rod-like members) and extend in substantially upright direction from the base 10. In some embodiments of the present invention, there are two support members 6, each with a slight curvature along a length of a rising portion thereof, as best seen in FIGS. 1*a* & 1*b*. Also, the base 10 is weighted to enhance stability of the stand 6 and lamp assembly 2. An outer edge perimeter 10' of the base 10 can be shaped to approximate a substantially circular profile; however, various other profile shapes are contemplated.

Figure 2:
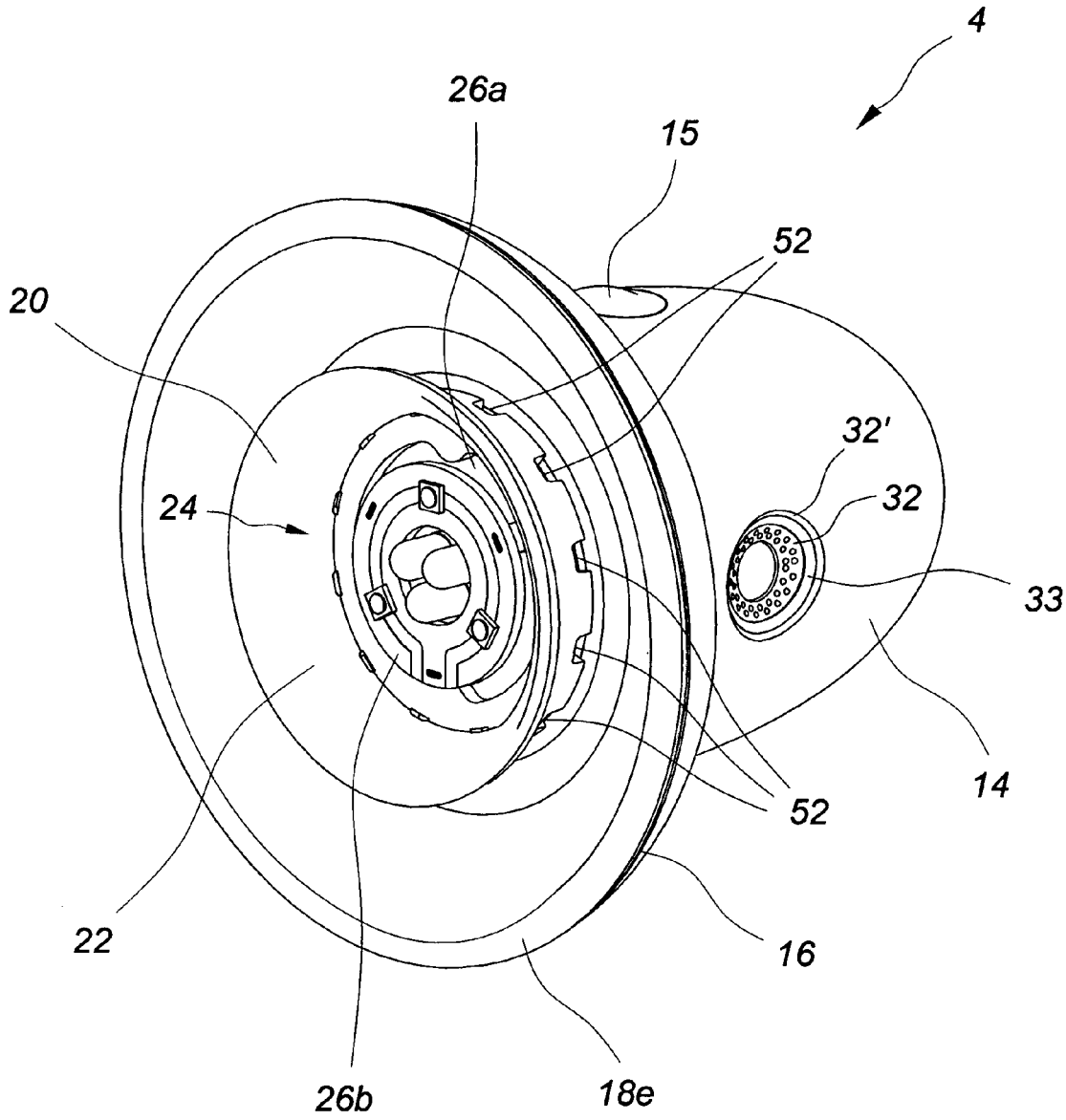
FIG. 2 is an enlarged perspective view of the portable lamp of FIG. 1.

Referring to FIG. 2, in some embodiments of the present invention the portable lamp 4 has a body section 14 and an expanding head section 16. As illustrate in FIG. 3, the expanding head section 16 can have two concentrically disposed outer circumferential walls 18*a*, 18*b*. The two outer circumferential walls (first outer circumferential wall 18*a* and second outer circumferential wall 18*b*) are centered about a longitudinal axis of the body section 14. Each of the outer circumferential walls 18*a*, 18*b* also expand laterally outward and curve forward in a direction away from the body section 14. Furthermore, a forward end portion of the second circumferential wall 18*b* can flare outward and overlap a forward end portion of the first outer circumferential wall 18*a* to form a flanged rim 18*e*.

Figure 3:
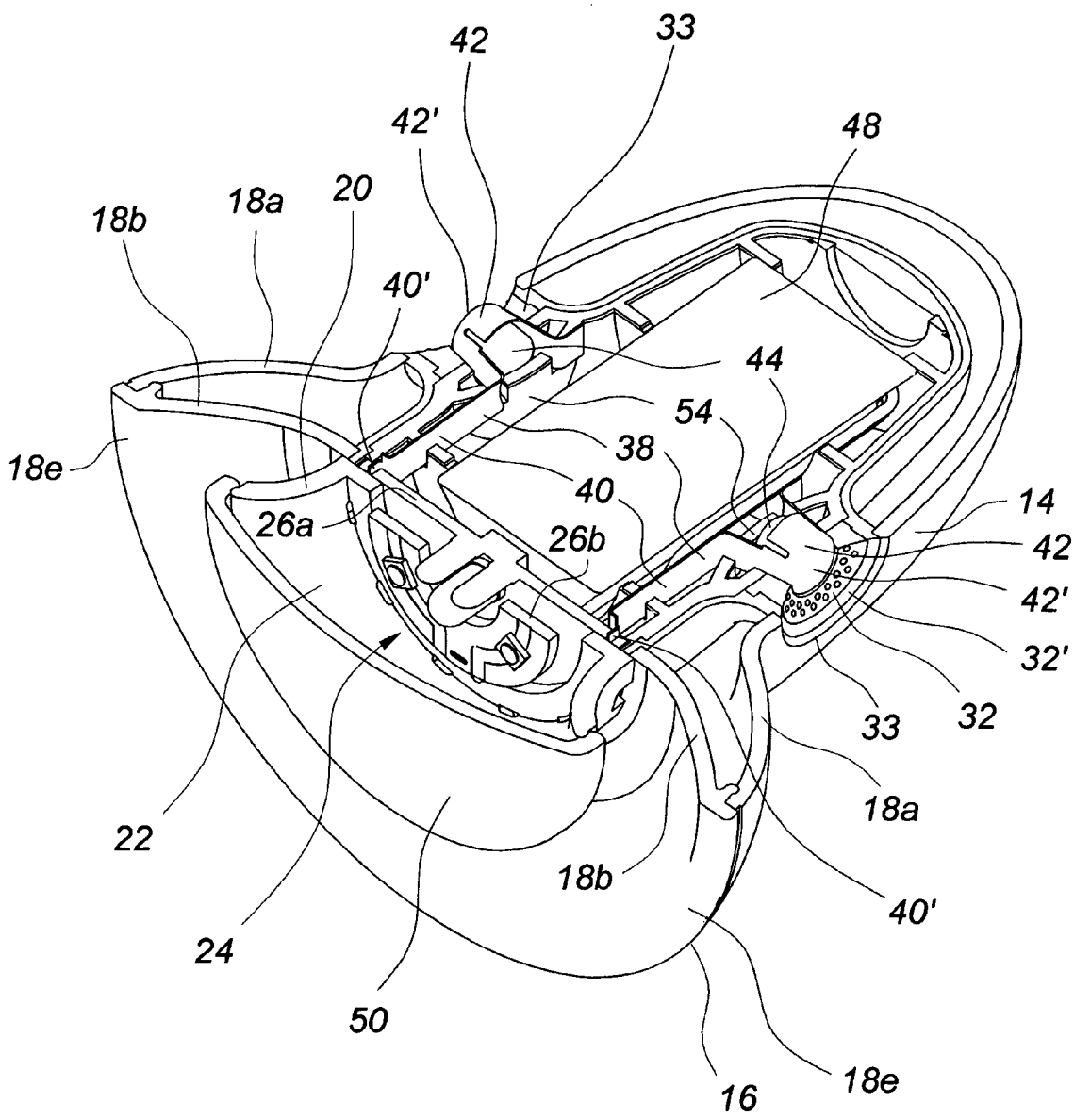
FIG. 3 is a perspective section view of the portable lamp in FIG. 2, showing magnets and lever springs disposed within a body section of the portable lamp.

As illustrated in FIGS. 2 & 3, some embodiments of the present invention also include an inner circumferential wall 20 extending forward away from the body section 14. The inner circumferential wall 20 is also centered about the longitudinal axis of the body section 14 and has an innermost wall surface 22. The innermost wall surface 22 can be reflective in some embodiments of the present invention.

Figure 4:
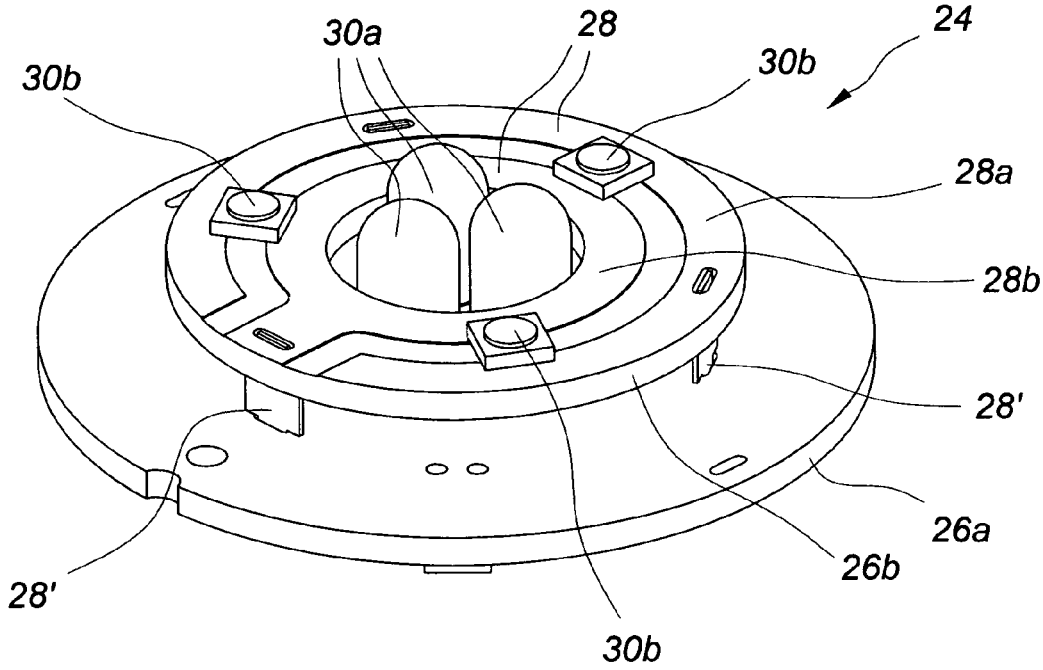
FIG. 4 is a detail perspective view of an LED circuit board assembly of the portable lamp illustrated in FIG. 2.
Figure 5:
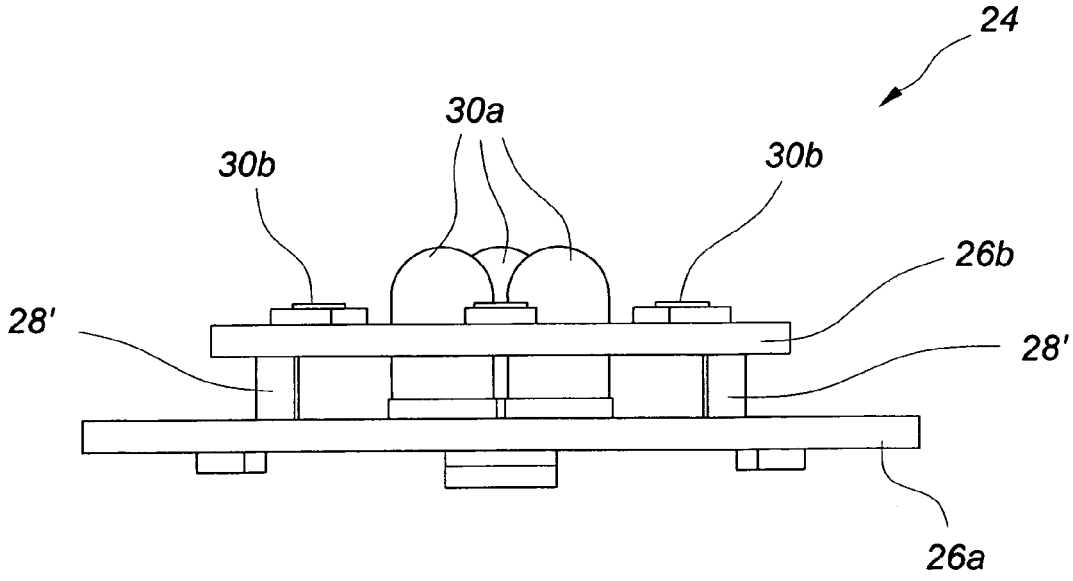
FIG. 5 is a side elevation view of the LED circuit board assembly of FIG. 4.

A circuit board assembly 24 with light emitting diodes (LED) coupled thereto, can be disposed within the inner circumferential wall 20, as can be seen in FIGS. 2 & 3. Referring to FIGS. 4 & 5, the circuit board assembly 24 can be a dual level circuit board and can include a lower circuit board section 26*a* and an upper circuit board section 26*b*. Conducting members are disposed on each of the circuit board sections 26*a*, 26*b* (the conducting members of the lower circuit board section 26*a* have not been illustrated in the drawings, and one of ordinary skill in the art will appreciate upon review of this disclosure that many well known conducting members are suitable for use thereon). The conducting members, such as conducting members 28 on the upper circuit board section 26*b*, are electrically coupled to a portable power source 48 that can be contained within the body section 14. Suitable power sources can include, without limitation, one or more rechargeable AA NiMH batteries. In some embodiments, three (3) batteries are provided. In other embodiments, less than three, or more than three, batteries are provided.

The LEDs of the circuit board assembly 24 can be of the same type and specification, or can be of differing types and specifications. For example, in the illustrated embodiments in FIGS. 4 & 5, lamp-style narrow beam LEDs 30*a* are used in combination with surface mount wide angle LEDs 30*b*. The narrow beam LEDs 30*a* can have focusing lenses, such as those widely available and suitable for use in LED flashlight type applications. The narrow beam LEDs 30*a* can be disposed at or proximate a central portion of the circuit board assembly 24, and can be electrically coupled to conducting members of the lower circuit board section 26*a*. The wide angle LEDs 30*b* are coupled to conducting members 28 of the upper circuit board section 26*b*. In some embodiments of the present invention, the wide angle LEDs used do not have lenses.

In some embodiments of the present invention, the upper circuit board section 26*b* is formed with an annular shaped profile and is retained by conductive risers 28' at a spaced apart elevation above the lower circuit board section 26*a*. The conductive risers 28' can comprise a portion of a power supply circuit for the wide angle LEDs 30*b* (or another type of LED coupled to the upper circuit board section in other embodiments). As will be appreciated by those skilled in the art after reviewing this disclosure, various current flow configurations may be suitable for use with the present invention. However, as an example, in some embodiments of the present invention, current can flow from the portable power supply 48 to reach at least one of a plurality of conductive risers 28' then flow to an inner conducting member 28*b* of the upper circuit board section 26*b*. The current can proceed from the inner conducting member 28*b* to LEDs 30*b*, then to an outer conducting member 28*a* and back down through another of the conductive risers 28' connected to the outer conducting member 28*a*, to be returned through a return circuit to the portable power source 48.

In some embodiments of the present invention, the wide angle LEDs 30*b* are high power LEDs and can be, for example, ½ watt to 1 watt LEDs, to facilitate light intensity over a wider area of illumination. Heat generated by use of high-powered LEDs, such as the wide angle LEDs 30*b* used in some embodiments of the present invention, can require dissipation. Referring to FIG. 3, in some embodiments of the present invention, a translucent cover 50 is coupled to the inner circumferential wall 22 to cover the circuit board assembly 24. This can result in heat buildup beneath the translucent cover 50 unless a manner of heat dissipation is available. As shown in FIG. 2, convection ways 52 can be formed on or near a lower portion of the inner circumferential wall 20 so that air within the inner circumferential wall 2 can be in direct communication with ambient air to assist in heat dissipation. Referring to FIGS. 4 & 5, moreover, it is notable that the raised upper circuit board section 26*b* can supply heat transfer area on both a bottom surface (not shown) and the top surface of the upper circuit board section 26*b* to help promote rapid heat dissipation. A heat conductive material can thus be provided on both the bottom surface and top surface of the upper circuit board section 26*b*, such as the conducting members 28. The heat conducting material on both the top surface and bottom surface can be in conductive communication, as will be appreciated by those skilled in the art after reviewing this disclosure. For example, LEDs 30*b* can be soldered connected to the conducting members 28 and during operation of the LEDs 30*b*, heat can be dissipated through conducting members on both the top and bottom surface of the upper circuit board section 26*b*.

Figure 8:
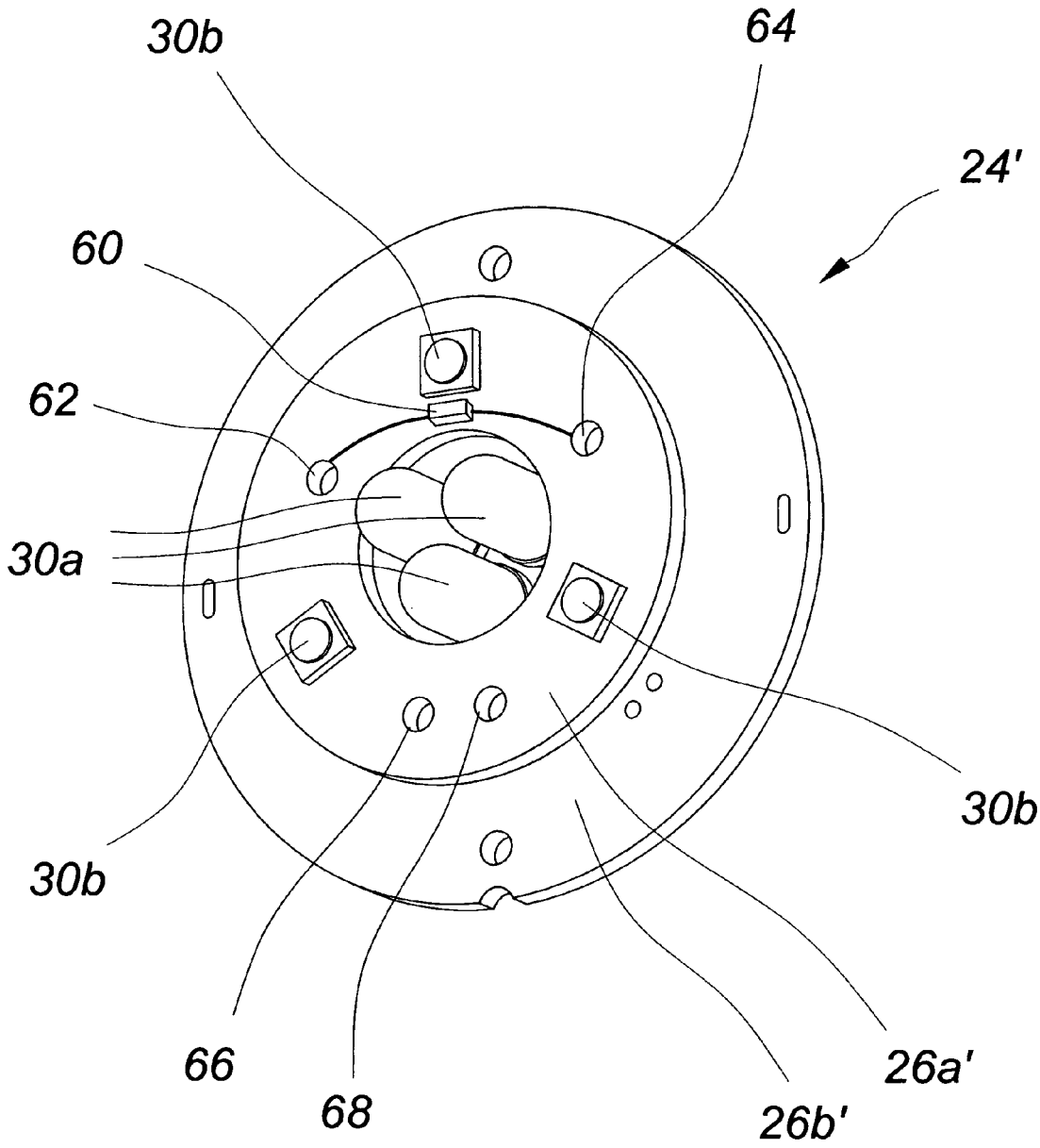
FIG. 8 is a perspective view of an alternate embodiment of a circuit board assembly for use with some embodiments of the present invention, also showing a thermally sensitive resistor for monitoring temperature proximate the circuit board assembly.

As can be seen in FIG. 8, in further embodiments of the present invention, the circuit board assembly 24' of the portable lamp 4 can have one or more thermally sensitive resistors 60, for use in monitoring temperature proximate at least one of the LEDs 30*b* and for providing input to a control circuit. That is, a control circuit can also be provided for controlling light intensity of at least one of said LEDs as a function of temperature, to further help prevent overheating the portable lamp 4. Those of ordinary skill in the art will appreciate upon review of this disclosure that a wide variety of control circuit configurations are available and suitable for use in combination with the present invention to achieve these objectives. For example, an interlock circuit can be provided to adjust light intensity of the LEDs 30*b*, based on a specified temperature, as measured using the thermally sensitive resistor 60. In another embodiment of the present invention, a control circuit is employed to variably adjust intensity of the LEDs 30*b* as a function of comparing measured temperature against various preset temperatures points.

Figure 6:
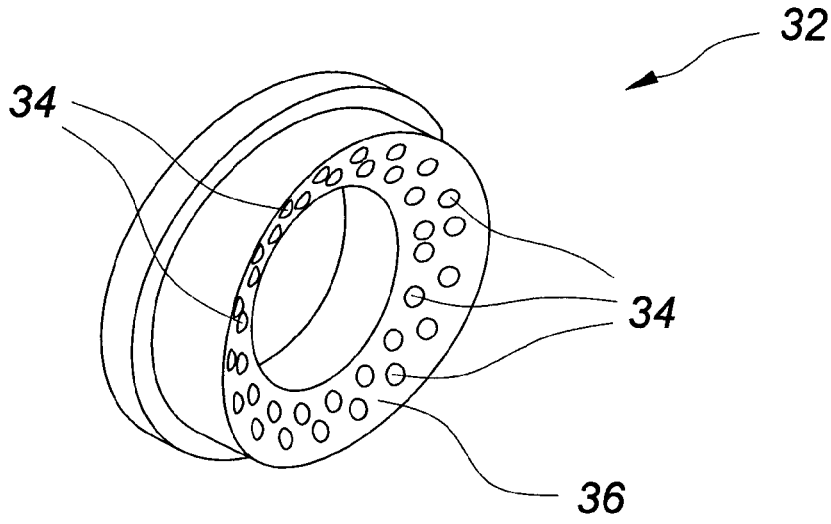
FIG. 6 is a detail perspective view of a gripper ring provided on some embodiments of the present invention.

Now referring to a manner of connection between the portable lamp 4 and the stand 6, as best seen in FIGS. 1*a* & 1*b*, a connector 12 can be provided on an upper end portion of each support arm 8. The connectors 12 can be spherically shaped. In some embodiments, the support members 8 are flexible while providing some spring characteristics for urging the connectors 12 inward toward magnetic mating portions 33 of the portable lamp 4. The connectors 12 can be metallic and capable of being attracted to a magnetic field exerted by the mating portions 33, for removably attaching the portable lamp 4 to the stand 6. As shown in FIG. 2, the mating portions 33 can comprise a recess 32' having a circular profile entryway with a gripper ring 32 disposed therein. The gripper ring 32 can be formed from any of a variety of conventional materials useable for the manufacture of sealing O-rings. The gripper rings 32 can provide a frictional surfaces for mating against the connectors 12 of the stand 6. An example frictional surface includes protruding gripping members 34, such as those shown in FIG. 6.

The gripper ring 32 can help stabilize the portable lamp 4 from undesired rotation about a lateral axis when it is removably attached to the stand 6 using the magnetically attractive force exerted by a the mating portion 33 on the connectors 12. However, a user can selectively pivot the portable lamp 4 about the lateral axis running through the connectors 12, without unreasonable effort.

Figure 7:
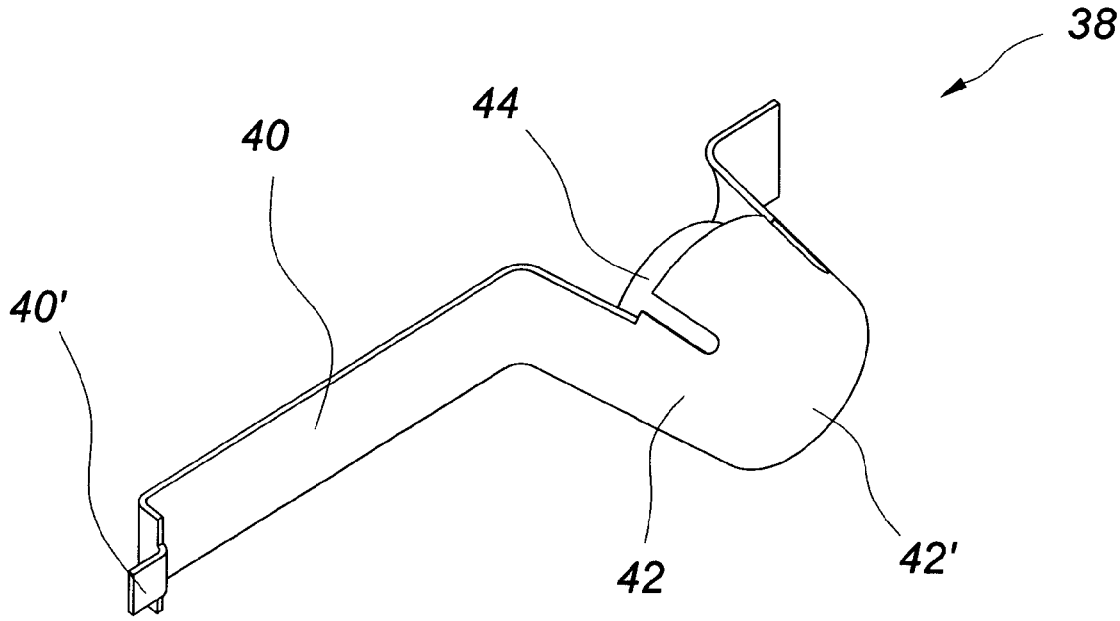
FIG. 7 is a detail perspective view of a lever spring used with some embodiments of the present invention.

As best seen in FIGS. 3 & 7, the mating portions 33 can have magnets 44 that are held in place by cups 42 of lever springs 38. The magnets 44 are retained between retaining stops 54 and an inside surface of the cups 42. Outwardly facing contact surfaces 42' of the cups 42 face outwardly away from the portable lamp 4 and form an inner surface of the recess 32'. In some embodiments, when the connectors 12 are mated to the mating portions, the connectors 12 touch the contact surfaces 42' of the cups 42. The magnets 44 attract the connectors 12 through the contact surfaces 42', to help removably retain the portable lamp 4 on the connectors 12.

Still referring to FIGS. 3 & 7, as well as FIG. 1*a*, when the portable lamp 4 is brought into proximity of the connectors 12, the magnets 44 and the lever portions 40 of the lever springs 38 urge the contact surfaces 42' toward the connectors 12 while a spring characteristic of the upright support members 8 of the stand 6 can urge the connectors 12 toward the contact surfaces 42'. This can aid in forming a circuit comprising the contact between the cups 42 and connectors 12 (as described below), in addition to functioning for retaining the portable lamp 4 in the stand 6.

In some embodiments of the present invention an external-power supply circuit for carrying current from an external power supply to the portable lamp 4 is provided. The external-power supply circuit can include an external power supply source (e.g., electrical outlet), intermediate components such as a power adapter (not shown), the support members 8 (which can be conducting rods themselves) and the connectors 12. In some preferred embodiments of the present invention, the connectors 12 themselves also form a portion of the external-power supply circuit such that when the portable lamp 4 is attached to the stand 6, the batteries 48 within the portable lamp can be recharged via power originating from an electrical outlet that is transferred through the support member 8 and connectors 12. In such embodiments, the lever portion 40 of lever spring 38 can also be a portion of the external-power supply circuit for supplying power to recharge the batteries 48 or to power the LEDs 30*a*, 30*b*, as will be appreciated by those skilled in the art after reviewing this disclosure.

In some embodiments of the present invention, the narrow beam, or narrow angle LEDs 30*a* and the wide angle LEDs 30*b*, are configured to be selectively operable by a user, with different light intensity levels available for the different LEDs. For example, in some embodiments, the user can selectively adjust intensity or brightness of the wide angle LEDs 30*b* without adjusting light intensity of the narrow angle LEDs 30*a*. These embodiments can also include switching power on or off from the wide angle LEDs 30*b* without affecting power supplied to the narrow angle LEDs 30*a*, and vice versa. As those skilled in the art will appreciate after reviewing this disclosure, various types of conventional or widely available switch or dimmer configurations can be used to achieve these selectable functions. Various actuating members such as toggle switches or push-and-hold buttons can be employed in combination therewith to effectuate dimmer functions or on-off functions. For example, in some embodiments of the present invention, a single actuating member (e.g., button) is provided that can be used to toggle between control of the wide angle LEDs 30*b* and narrow angle LEDs 30*a* and can also be pushed and held to dim or brighten one or more LEDs. One of ordinary skill in the art will appreciate many available manners of implementing these control configurations after reviewing this disclosure.

It is also contemplated that various other types of LEDs, providing different qualities of light, can be implemented in place of, or in combination with, the LEDs described thus far. For example, in some embodiments of the present invention, there may be three or more different types of LEDs, having differing specifications, utilized on the circuit board assembly 24. All of the various manners of control disclosed herein may be used to operate those different LEDs independently to provide flexibility in quality of light delivered.

Although specific embodiments and examples of the invention have been described supra for illustrative purposes, various equivalent modifications can be made without departing from the spirit and scope of the invention, as will be recognized by those skilled in the relevant art after reviewing the present disclosure. The various embodiments described can be combined to provide further embodiments. The described devices and methods can omit some elements or acts, can add other elements or acts, or can combine the elements or execute the acts in a different order than that illustrated, to achieve various advantages of the invention. These and other changes can be made to the invention in light of the above detailed description.

In general, in the following claims, the terms used should not be construed to limit the invention to the specific embodiments disclosed in the specification. Accordingly, the invention is not limited by the disclosure, but instead its scope is determined entirely by the following claims.

What is claimed is:

1. A lamp assembly comprising:

a base;

at least one elongated upright support member attached to the base and having a connector; and a portable lamp having a mating portion configured to mate with the connector for removably attaching the portable lamp to the upright support member, wherein at least one of the mating portion and connector comprises a magnet for holding the portable lamp, and wherein an external-power supply circuit can run through the connector and upright support member for supplying power to the portable lamp when the portable lamp is attached to the upright support member and wherein the portable lamp has an internal power source separate from the base and is operable to provide illumination both when attached to the upright support member and when detached from the upright support member.

2. The lamp assembly of claim 1 wherein the connector is spherical.

3. The lamp assembly of claim 1 wherein the support member is upright and cylindrical in shape and wherein the connector is disposed at an end portion of the upright support member.

4. The lamp assembly of claim 1 wherein the connector is spherical and the mating portion of the portable lamp comprises a recess for receiving at least a portion of the connector.

5. The lamp assembly of claim 4 further comprising a gripper ring disposed within the recess, the gripper ring having a surface configured to provide friction between the connector and the mating portion of the portable lamp when the portable lamp is attached to the support member.

6. The lamp assembly of claim 5 wherein the surface of the gripper ring comprises a plurality of raised gripping members.

7. The lamp assembly of claim 1 wherein there are at least two upright support members each having a connector disposed on an end portion thereof, and wherein each of the upright support members is cylindrical in shape and wherein the upright support members are flexible with spring characteristics that urge the connectors toward the portable lamp when it is attached to the upright support members.

8. The lamp assembly of claim 1 wherein the portable lamp is an LED lamp comprising:

a circuit board assembly;

at least one narrow angle LED coupled to the circuit board assembly, the narrow angle LED having a lens for focusing a beam of the LED;

at least one wide angle LED coupled to the circuit board assembly; and at least one actuating member for a user to selectively control intensity of at least one of the narrow angle LED and wide angle LED.

9. The lamp assembly of claim 8 wherein the user can selectively control intensity of the at least one of the narrow angle LED and wide angle LED without affecting an intensity of the other of the narrow angle LED and wide angle LED.

10. The lamp assembly of claim 8 wherein there are a plurality of narrow angle LEDs and a plurality of wide angle LEDs, and wherein the wide angel LEDs are disposed about a perimeter of the narrow angle LEDs.

11. The lamp assembly of claim 8 wherein the circuit board assembly comprises a plurality of circuit board sections disposed at different elevations.

12. The lamp assembly of claim 11 wherein an upper circuit board section is supported above a lower circuit board section by conductive risers, the conductive risers also being used to form a circuit for the upper circuit board section.

13. The lamp assembly of claim 11 wherein at least one of the wide angle LED and narrow angle LED is disposed on an upper circuit board section.

14. The lamp assembly of claim 11 wherein an upper circuit board section has a top surface and a bottom surface with heat conducting material on both surfaces.

15. The lamp assembly of claim 8 further comprising a thermally sensitive resistor for monitoring temperature proximate at least one of the LEDs.

16. The lamp assembly of claim 15 further comprising an LED control circuit for controlling light intensity of at least one of said LEDs as a function of temperature.

17. The lamp assembly of claim 15 wherein the LED control circuit is an interlock circuit that adjusts light intensity of at least one of the LEDs when a specified temperature is sensed by a physical change in the thermally sensitive resistor.

18. A portable LED lamp assembly comprising:

a stand having a base with a plurality of upright elongated support members, the elongated support members having connectors that serve as electrical conductors; and a portable LED lamp having mating portions for mating with the connectors and for forming an external-power supply circuit with the connectors for supplying power to the portable LED lamp, the portable LED lamp being removably and pivotably attachable to the elongated support members using magnets, and wherein when the portable LED lamp is removed from the elongated support members it is operable for illumination using an internal power source within the portable LED lamp.

19. The portable LED lamp assembly of claim 18 wherein at least one magnet is disposed in at least one of the connectors or mating portions to exert a magnetic field of attraction on a corresponding connector or mating portion when the portable LED lamp is mated to the connectors.

20. The portable LED lamp assembly of claim 18 further comprising a circuit board assembly having an upper circuit board section and a lower circuit board section, with at least one LED coupled to each of the upper circuit board section and lower circuit board section.

21. The portable LED lamp assembly of claim 18 wherein there is at least one convection way provided in a wall of the portable LED lamp to facilitate heat dissipation away from a circuit board assembly of the portable LED lamp.

22. The portable LED lamp assembly of claim 18 further comprising a lever spring having a cupped portion for retaining a magnet within the portable LED lamp.

23. The portable LED lamp assembly of claim 18 wherein at least one of the mating portions comprises a magnet, and wherein the magnet forms at least part of the external-power supply circuit with the connectors.

24. The portable LED lamp assembly of claim 18 further comprising both wide angle LEDs and narrow beam LEDs coupled to a circuit board of the portable LED lamp.

25. The portable LED lamp assembly of claim 24 wherein the wide angle LEDs are disposed about a perimeter of the narrow beam LEDs.

26. A method of lighting comprising:

attaching a portable lamp to a detachable stand using a magnet;

supplying power to the portable lamp through at least one of the magnet and a conductor adjacent the magnet to charge a portable power supply source within the portable lamp;

pivoting the portable lamp about a lateral axis while it is attached to the stand by the magnet;

removing the portable lamp from the detachable stand; and illuminating a surface using LEDs of the portable lamp with the portable lamp being detached from the stand and operating on independent power supplied by a power source within the portable lamp.

* * * * *